US009895737B2

(12) United States Patent
Caunter et al.

(10) Patent No.: US 9,895,737 B2
(45) Date of Patent: Feb. 20, 2018

(54) PACKAGING CAN AND METHOD AND APPARATUS FOR ITS MANUFACTURE

(71) Applicant: Crown Packaging Technology, Inc., Alsip, IL (US)

(72) Inventors: Nicholas James Caunter, Taplow (GB); Tanya Ruth Gledhill, Abingdon (GB); Ian Maxwell, Caversham (GB); Maurice Riviere, Bois d'Arcy (FR)

(73) Assignee: Crown Packaging Technology, Inc., Alsip, IL (US)

( * ) Notice: Subject to any disclaimer, the term of this patent is extended or adjusted under 35 U.S.C. 154(b) by 161 days.

(21) Appl. No.: 14/273,906

(22) Filed: May 9, 2014

(65) Prior Publication Data

US 2014/0328649 A1 Nov. 6, 2014

Related U.S. Application Data

(63) Continuation of application No. 11/885,542, filed as application No. PCT/EP2006/060094 on Feb. 20, 2006, now Pat. No. 8,746,488.

(30) Foreign Application Priority Data

Mar. 1, 2005 (EP) ..... 05101552
May 11, 2005 (FR) ..... 0504741

(51) Int. Cl.
*B21D 51/10* (2006.01)
*B21D 51/26* (2006.01)

(52) U.S. Cl.
CPC ..... *B21D 51/2661* (2013.01); *B21D 51/10* (2013.01); *B21D 51/2653* (2013.01); *B65D 2577/205* (2013.01)

(58) Field of Classification Search
CPC ..... B65D 41/10; B65D 41/14; B65D 51/185; B65D 2577/205; B65D 39/02;
(Continued)

(56) References Cited

U.S. PATENT DOCUMENTS 1,332,838 A * 3/1920 Hodgson ..... B65D 7/36 413/7
1,435,384 A * 11/1922 Fleischer ..... B21D 51/2661 220/614
(Continued)

FOREIGN PATENT DOCUMENTS

DE 1922678 A1 11/1970
DE 8129904 U1 3/1983
(Continued)

*Primary Examiner* — Edward Tolan
(74) *Attorney, Agent, or Firm* — Baker & Hostetler LLP

(57) ABSTRACT

A can for packaging food, comprising a metal can body and a diaphragm lid (16) formed of lidding material which comprises a multilayer structure with at least an aluminum layer of from 6 to 90 microns thickness and a bond layer for fixing the lid (16) directly to the can body. One method for forming the can forms the lidding material by using an outwardly extending curl (20) at one end of the metal can body as the draw die. Lidding material which is carried by the body maker punch is drawn around the curl of the can body draw die so as to form the lidding material into a cup shape.

8 Claims, 9 Drawing Sheets

(58) Field of Classification Search
CPC .. B65D 41/145; B65D 77/20; B65D 77/2032; B65D 3/10; B21D 51/2653; B21D 51/2661; B21D 51/38; B21D 51/44; B21D 51/46; B21D 51/10
USPC ..... 413/2, 3, 26, 27, 43
See application file for complete search history.

(56) References Cited

U.S. PATENT DOCUMENTS 1,623,245 A * 4/1927 Hothersall ..... B21D 51/34 292/256.63
1,700,984 A * 2/1929 Hothersall ..... B21D 51/38 413/2
1,709,196 A * 4/1929 Vernon ..... B65D 43/021 413/4
1,989,091 A * 1/1935 Foss ..... B21D 51/38 220/260
2,214,399 A * 9/1940 Benson ..... B65D 17/08 220/309.1
2,467,154 A * 4/1949 Peterson, Jr. ..... B21D 51/32 413/32
2,633,095 A * 3/1953 Magill ..... B21D 51/32 222/215
3,190,481 A * 6/1965 McKnight, Jr. ..... B65D 41/125 215/345
3,371,811 A * 3/1968 McKnight ..... B65D 41/14 215/262
3,709,398 A 1/1973 Fuhrmann
3,807,332 A * 4/1974 Okubo ..... B21D 51/2676 156/200
3,952,677 A * 4/1976 Hartman ..... B21D 51/46 220/606
4,333,585 A * 6/1982 Del Bon ..... B21D 51/383 220/258.2
4,366,662 A 1/1983 Katsura et al.
4,447,184 A 5/1984 Buri et al.
4,555,208 A * 11/1985 Houdayer ..... B21D 51/34 413/2
4,599,123 A * 7/1986 Christensson ..... B29C 65/3656 156/273.7
4,744,484 A * 5/1988 Grabher ..... B21D 51/44 215/253
4,890,759 A 1/1990 Scanga et al.
4,905,858 A * 3/1990 Budenbender ..... B65D 7/045 220/612
4,961,513 A 10/1990 Gossedge et al.
5,186,592 A * 2/1993 Budenbender ..... B23K 26/206 219/121.64
5,457,943 A * 10/1995 Hertrampf ..... B65D 51/1661 53/331
5,562,799 A * 10/1996 Ross ..... B29C 65/46 156/567
5,577,370 A * 11/1996 Pajak ..... B65B 7/164 53/329.3
5,725,120 A * 3/1998 Ramsey ..... B65D 17/502 220/276
5,911,334 A 6/1999 Helms
5,913,798 A 6/1999 Grabher
5,996,835 A 12/1999 Farrington et al.
6,036,043 A 3/2000 Erfgen et al.
6,176,070 B1 * 1/2001 Grabher ..... B65D 3/10 156/583.1
7,757,879 B2 * 7/2010 Schuetz ..... B21D 51/44 220/258.2
8,807,374 B2 * 8/2014 Caunter ..... B21D 51/46 215/232
2001/0023870 A1 9/2001 Mihalov et al.
2002/0003143 A1 1/2002 Graye
2002/0034649 A1 3/2002 LeDu et al.
2009/0014448 A1 * 1/2009 Grabher ..... B65D 51/18 220/361

FOREIGN PATENT DOCUMENTS

DE 29817592 U1 11/1998
EP 209031 A1 1/1987
EP 0683110 A1 11/1995
EP 819086 1/1998
FR 2810014 A1 12/2001
WO WO 96/31406 A1 10/1996
WO 2004/083066 A1 * 9/2004 ..... B65D 51/20

* cited by examiner

[Fig. 001]
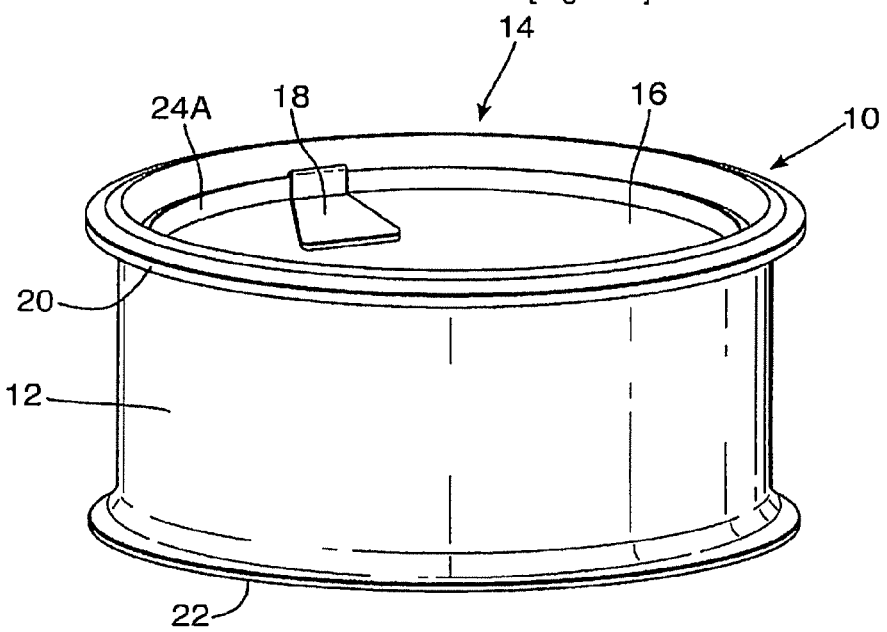
[Fig. 002]
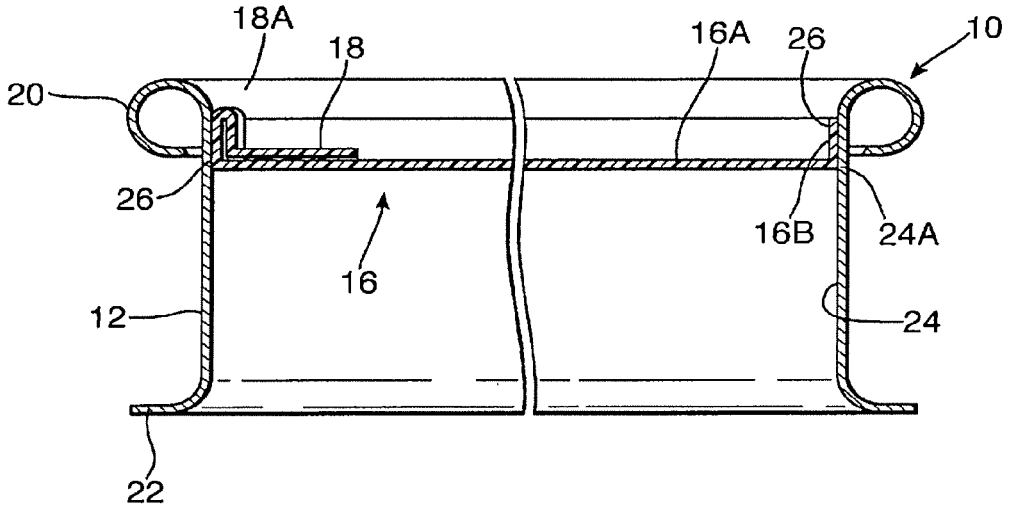

[Fig. 003]
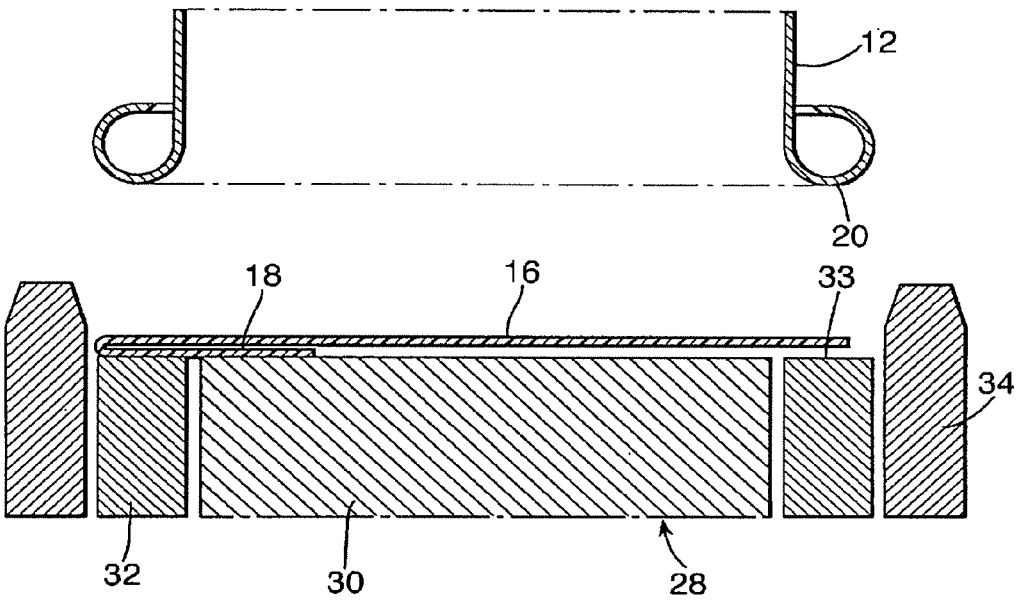
[Fig. 004]
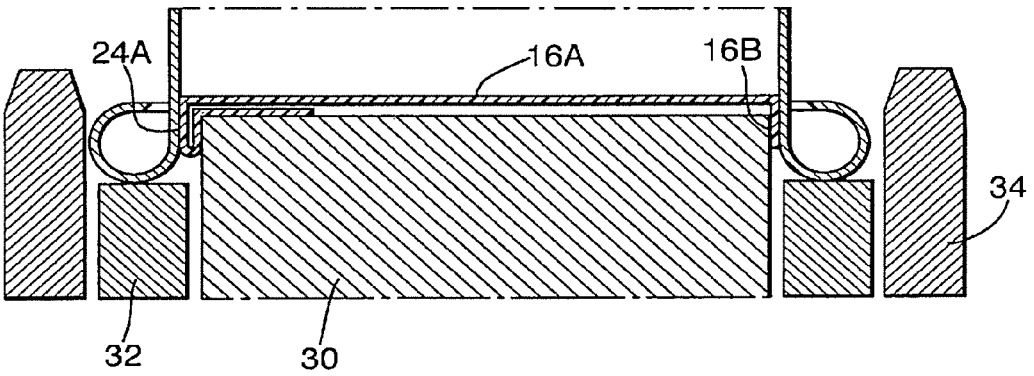
[Fig. 005]
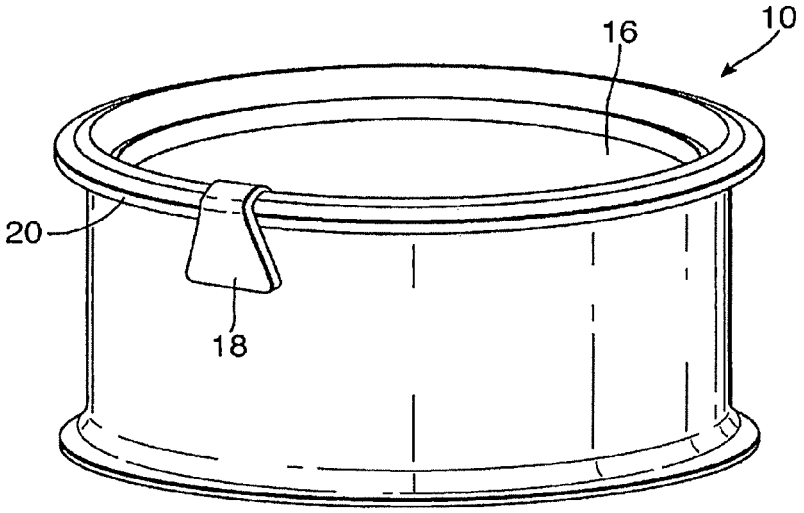

[Fig. 006]
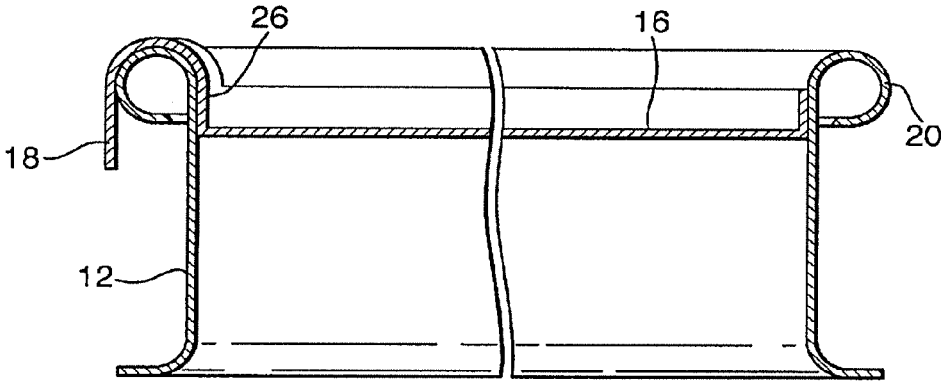
[Fig. 007]
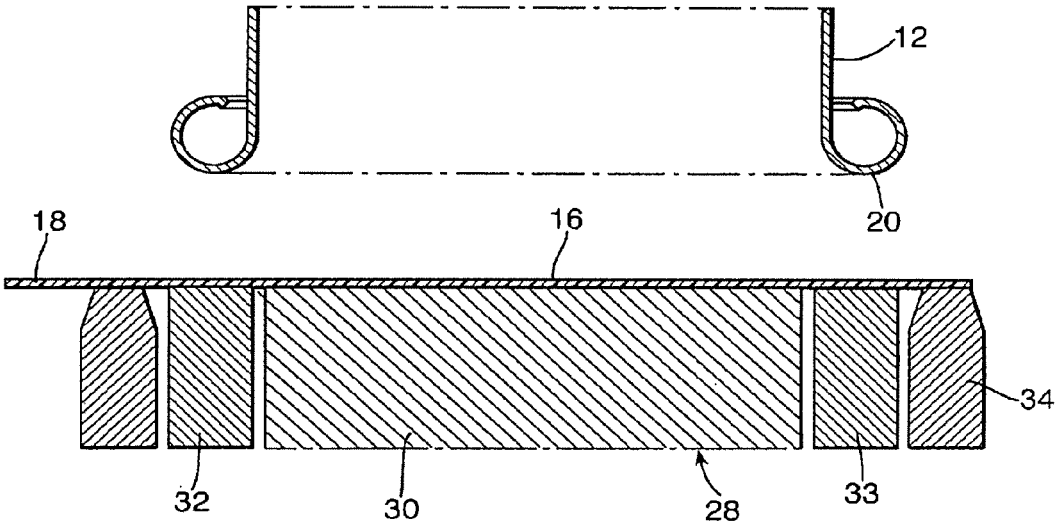
[Fig. 008]
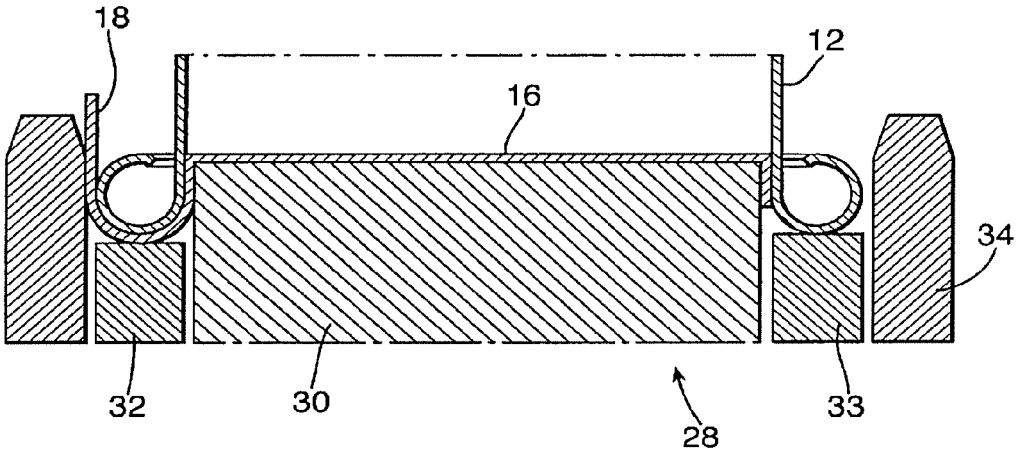

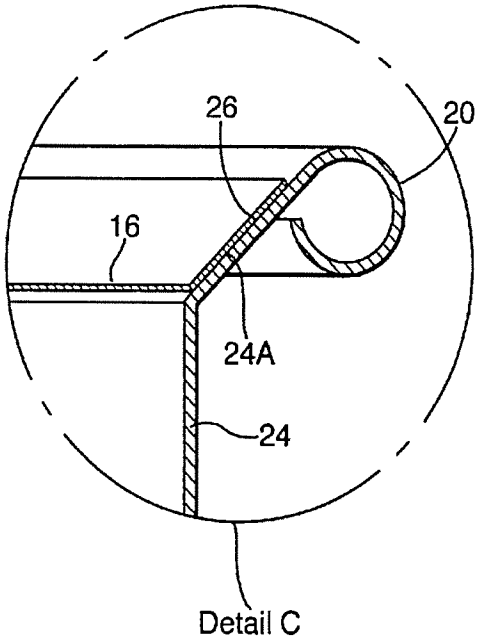
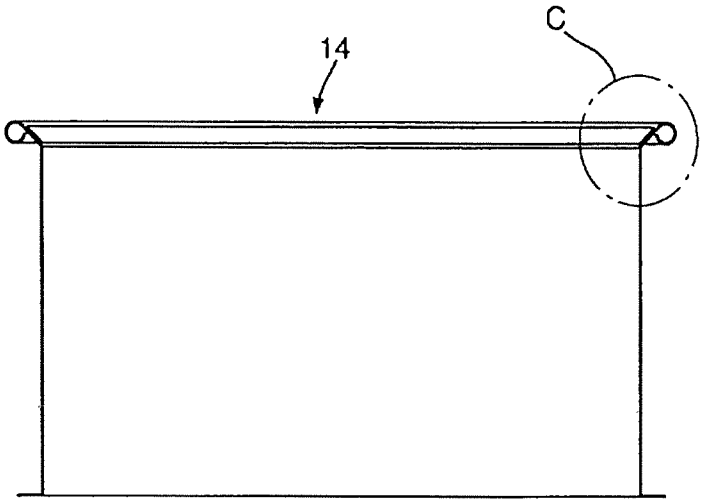
[Fig. 009]

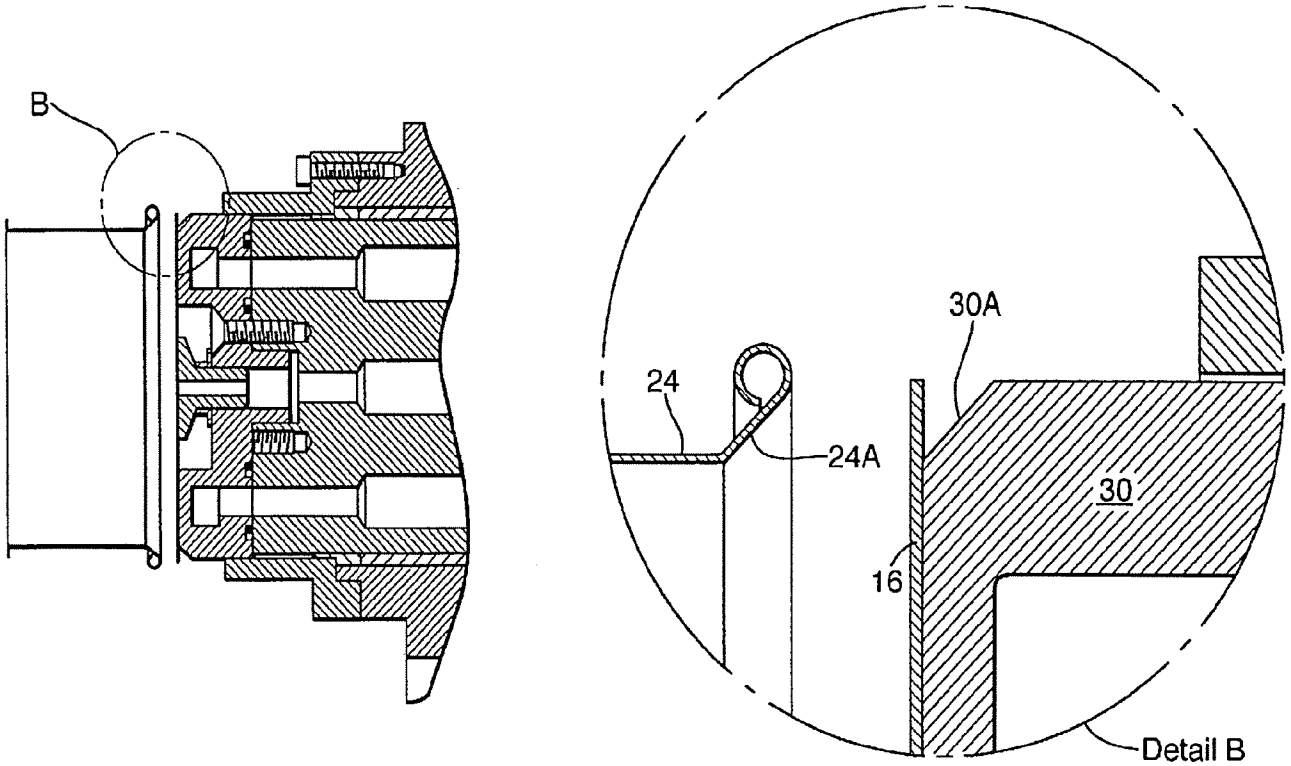
[Fig. 010]

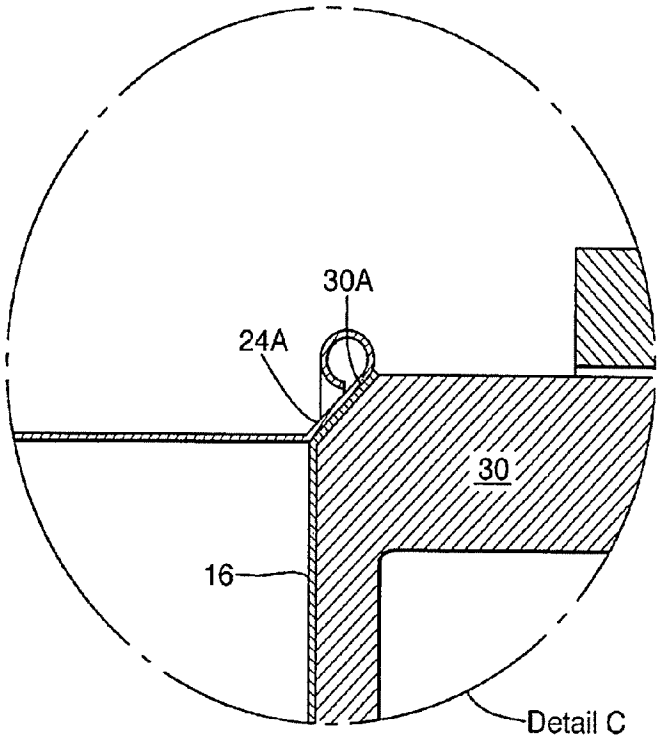
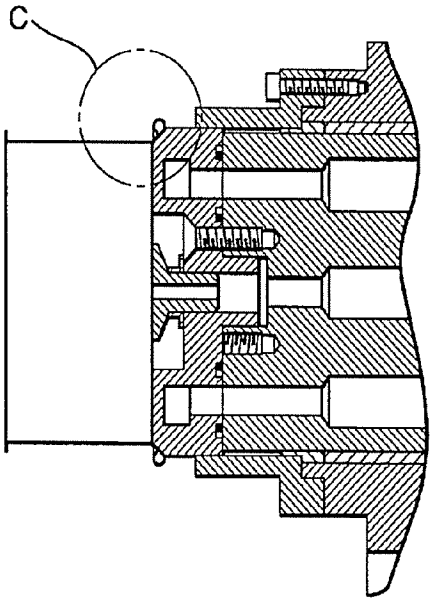
[Fig. 011]

[Fig. 012]
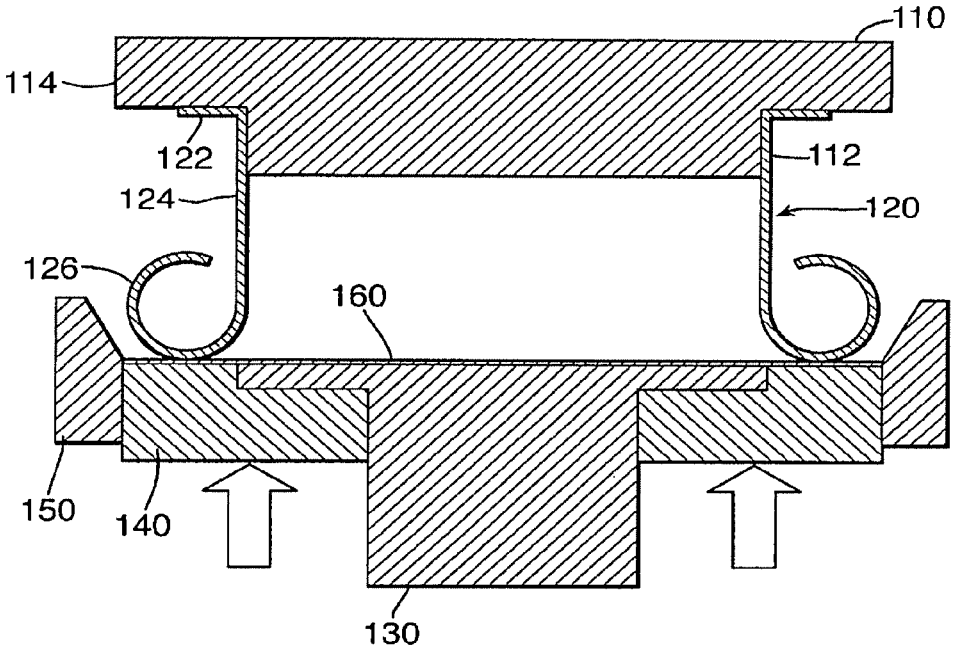
[Fig. 013]
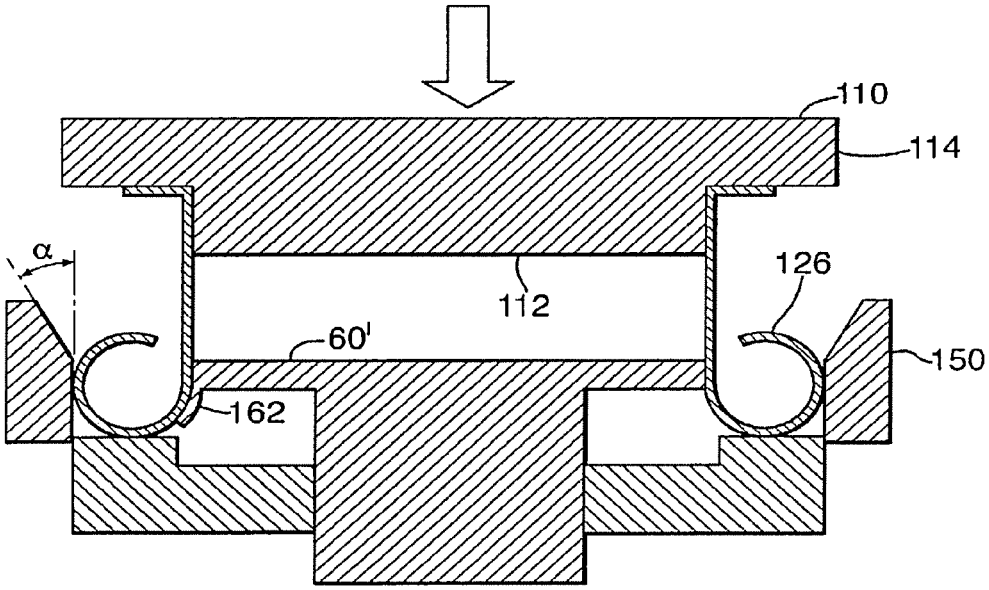

[Fig. 014]
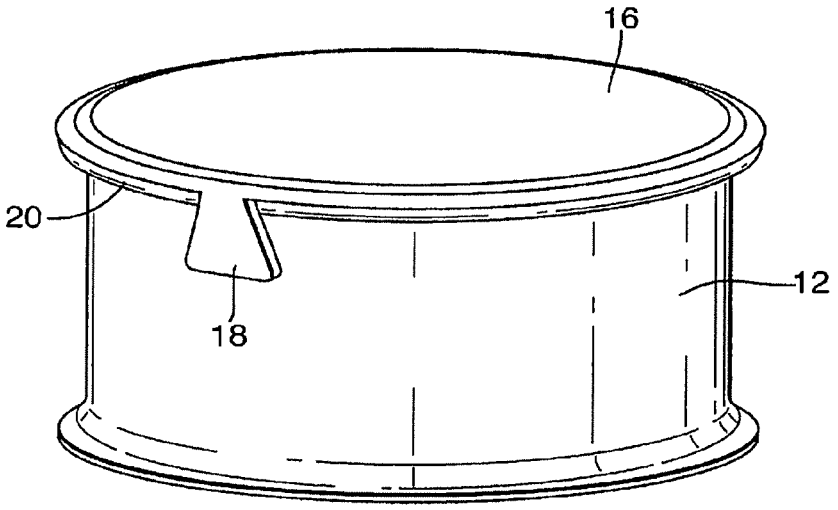
[Fig. 015]
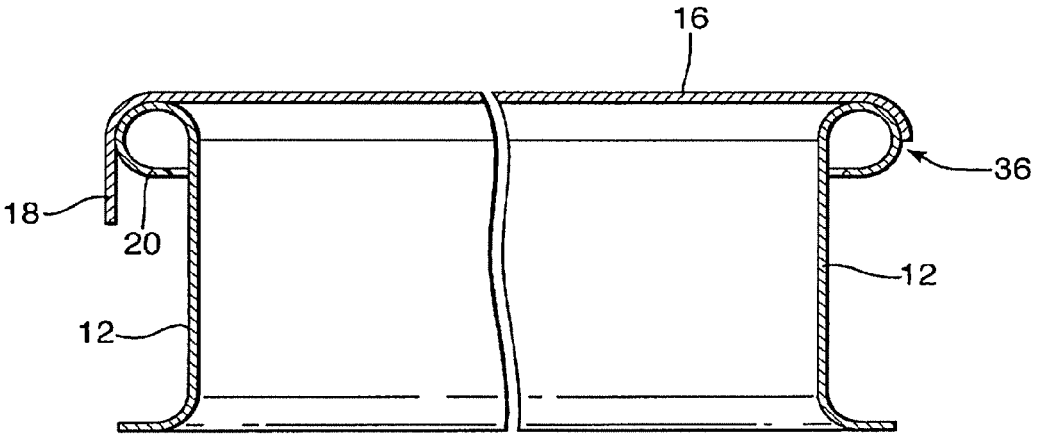

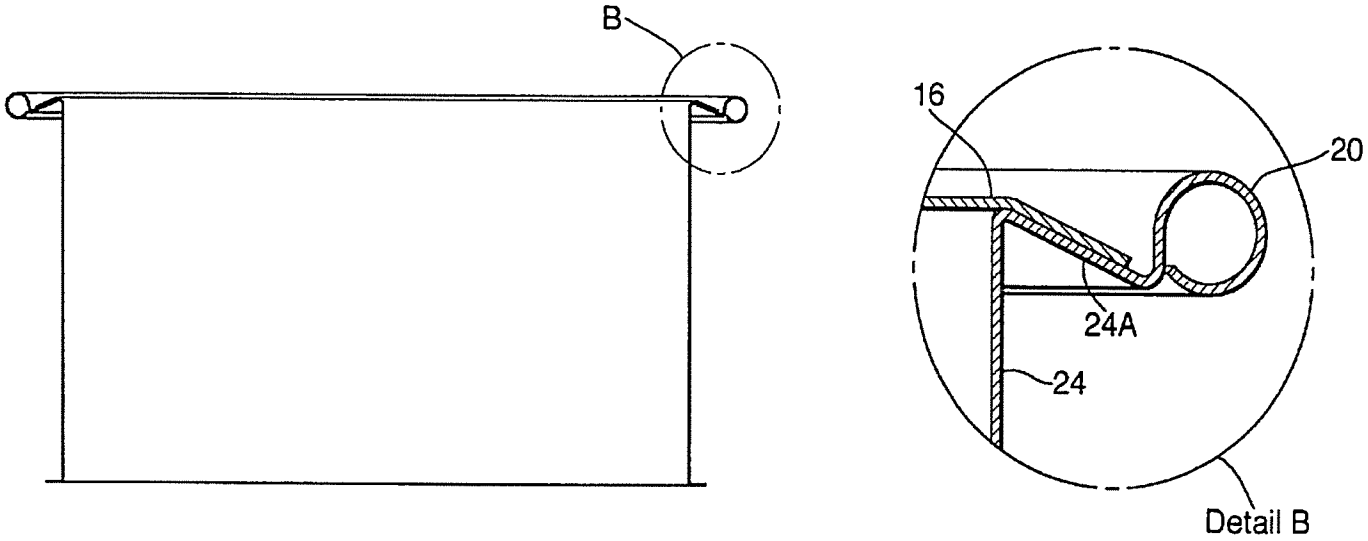
[Fig. 016]

PACKAGING CAN AND METHOD AND APPARATUS FOR ITS MANUFACTURE

CROSS-REFERENCE TO RELATED APPLICATIONS

This application is a continuation of U.S. patent application Ser. No. 11/885,542, filed Jun. 9, 2008 which claims priority to PCT Application No. PCT/EP2006/060094, filed Feb. 20, 2006, which claims priority to European Application No. 05101552.7, filed Mar. 1, 2005 and French Application No. 0504741, filed May 11, 2005, the entireties of which are incorporated by reference herein.

TECHNICAL FIELD

This invention relates to a can for packaging foodstuffs and a method and apparatus for forming such a can. The invention also relates to the forming of lidding materials for fixing to metal packaging such as metal cans.

In particular, but not exclusively, it relates to the packaging of solid food, for people or pets. Such cans will also be referred to hereinafter as "food cans."

BACKGROUND ART

Metal packaging is known in which a can body having a metal ring seamed to one end of the can body supports a peelable lid which comprises a multi-layer membrane having typically a peelable polypropylene layer, a layer of aluminum, and an outer layer of print, lacquer, PET or other coating. The material of the lidding material is generally chosen according to the requirements dictated by the product with which the can body is filled. For example, there is a need for maintaining seal integrity during processing, sterilization etc. of food products but the lid must also be capable of being readily opened for access to the food for consumption.

The use of an intermediate metal ring to support the lidding material is usual for optimum seal integrity. However, the production of this ring leads to substantial wastage of material since the central part of the ring cannot economically be re-used for conventional can component sizes. In addition, the ring may reduce access to the can contents. Manufacturing time using separate stages for manufacturing the ring and fixing the lidding material to this ring is also long. There is therefore a need to provide a container in which the lid is bonded directly to the can body, thereby obviating the need for an intermediate component. Manufacture of the packaging can of the invention is also simplified so as to reduce manufacturing costs, whilst facilitating access to the contents of the finished can.

EP-0819086 describes a process for manufacturing a can with a foil membrane, in which the membrane is preformed with a raised edge and is inserted into the can so that the outside edge region is raised in the direction of the can axis. The edge is then connected to the inside of the can wall by an adhesive bond or heat seal. This process is inherently slow because not only does the foil membrane require preforming but careful handling is needed for location in the can body. The can body also has to be removed from the can making line or pass through one or more separate stations for pressing the membrane onto can body wall.

SUMMARY

According to the present invention, there is provided a can for packaging food, comprising: a metal can body having an access opening; and a lid for closing the access opening, the lid being fixed directly to the can body; characterized in that the lid is formed of lidding material which comprises a multilayer structure with at least an aluminum layer of from 6 to 90 microns thickness and a bond layer.

Typically, the bond layer of the lidding material is of polypropylene or a modified polypropylene. The can body may be formed from a metal sheet which is coated with a lacquer having polypropylene dispersed in the lacquer. The sheet may then be formed by welding, for example, into a cylinder to provide the can body. The side seam thus formed is generally separately coated with a similar internal lacquer or with a polypropylene powder. Alternatively, the plate could be coated with a conventional lacquer and a specific lacquer, such as one including a dispersion lacquer, used only for coating that part of the can wall and weld which is to contact the foil lidding material.

In one embodiment, the lid may also include an integral tab which may be folded back onto the lid and, optionally, at least partly fixed to the lid, for example by heat sealing or fusion of material so as to keep the tab folded back onto the lid.

The lid may be fixed by tightly heat sealing for fusion of the lidding material directly onto the can body sidewall. Inclining the sealing surface at an angle ensures that opening of the closed container is not entirely in shear mode as would happen when the sealing surface is vertical and the pull is vertical. By increasing the sealing surface angle, the container has been found to be easier to open without risking tearing off the tab, even if the customer pulls vertically.

A further advantage of the inclined sealing surface is that the incidence of wrinkles in the lidding material is reduced adjacent the can sidewall and localized peel from the can sidewall is eliminated.

In one embodiment of the invention, the sealing surface may be inclined at angles ranging from 20° to 150° to the vertical. Angles of above 90° are preferred for containers in which the lidding material is deflected in order to control in-can pressure during processing of the food product in the container. So-called barometric ends can be used for processing in, for example, reel and spiral retorts. By increasing the wall angle above 90°, this angle becomes greater than the angle subtended by the extremity of the lidding material in its outwardly domed position. As a result, the bond only undergoes shear loading, which effectively doubles burst pressure performance from that of standard cans which are loaded in peel mode.

Although trials have shown that ease of opening increases as the angle increases, the edge of the sidewall protrudes beyond the main sidewall diameter as the sealing surface is inclined. This can cause problems for handling and stacking. For this reason, 90° angles are avoided and for non-barometric ends, preferred sealing surface angles are from 20° to 60° to the vertical, ideally from 30° to 50°. For barometric ends, preferred sealing surface angles are up to 135° to give sufficient dome size. Thus for ease of opening, angles of from 30° to 135° are preferred, but for handling, angles of substantially 90° tend to be avoided.

Preferably, the sealing surface is an inner surface of the can body which delimits the access opening. In this embodiment, the lid is substantially dish-shaped with a vertical or inclined sidewall according to the sealing surface angle. Alternatively, the sealing surface may be an "outer" surface of the can body which forms part of a peripheral curl bordering the access opening.

Optionally, the tab may extend over the outside of the can body. The lid and tab may comprise non-preformable material.

According to another aspect of the present invention, there is provided a method of manufacturing the above can by directly fixing the lid to the can body, for example by heat sealing or fusion of the lidding material. This method may typically comprise the steps of drawing the lid along a surface which is parallel or inclined at an angle to the can body centre axis; and sealing the lid directly to this surface. Alternatively, the method may comprise applying a part of the lid against a peripheral curl of the can body bordering the access opening; and drawing the lid along the surface while moving the lid in sliding support on the curl.

When the lid includes an integral tab, the method may include folding back the tab onto the lid either prior to or simultaneously with or after fixing the lid to the can body.

According to a still further aspect of the present invention, there is provided a method for forming a lidding material, the method comprising: supporting a lidding material on a punch; forming a metal can body having an outwardly extending curl at one end; supporting the opposite end of the can body on a base support; moving the can body and punch relative to each other; and drawing the lidding material which is carried by the punch around the curl of the can body so as to form the lidding material into a cup shape.

By drawing the lidding material around the can body and using the can body as a forming die, the lidding material can be both formed and held within the can body at a single station for fixing to the inner sidewall of the can body.

The step of moving the can body and punch relative to each other may be achieved by pushing the can body with the base support while the punch is moved into the can body, or holding the punch stationary while the can body is moved axially over the punch, or a combination of these.

According to a further aspect of the present invention, there is provided an apparatus for forming a lidding material, the apparatus comprising: a metal can body having an outwardly extending curl at one end; a base support for supporting the opposite end of the can body; and a punch; in which the can body acts as a forming die so that lidding material which is carried by the punch is formed into a cup shape by drawing around the curl of the can body.

The apparatus may also include an ejector die surrounding the punch so that relative movement between the ejector die and the can body releases the punch from the can body after forming of the lidding material. The ejector die may be surrounded by a locator die for holding the lidding material in position on the punch, prior to and during forming.

Preferably, the base support acts as a pusher, but in an alternative embodiment the punch could act as a pusher if the can is held stationary. Clearly it is also possible for both the base support and the punch to act as pushers, although this is less practical.

The base support may comprise a plate with a central mandrel extending from the plate into the can body. If the can body is flanged, then this flange may be located against the base support plate. The diameter of the central mandrel is selected for ease of sliding into the can body with a small clearance.

Ideally, the punch has an end portion which extends axially at least 2 mm. This end portion carries the lidding material as it forms around the can body so that the diameter of the punch end portion needs to be an interference fit or only sufficiently less than the can body inner wall and the thickness of the lidding material such that the cup shape formed by the lidding material is held for bonding against the can body sidewall without damaging the lidding material or base flange. The seal length may be greater than 2 mm, for example around 2.5 mm. The punch internal diameter may be slightly greater than the can internal diameter so as to stretch the can body in an interference fit to assist in providing pressure across the seal and create a good bond.

The apparatus preferably further includes an induction heater coil which surrounds the can body or is within the punch when the punch is holding the cup of lidding material against the can body inner wall. The base support, punch and other apparatus components other than the can body may be made of metals with low electrical conductivity, polymeric, glass or ceramic material so that the induction heater only induces heat in the can body and lidding material for bonding the lidding material to the can body inner wall.

BRIEF DESCRIPTION OF DRAWINGS

Preferred embodiments of the invention will now be described, by way of example only, with reference to the drawings, in which:

FIG. 1 is a perspective view of a food can according to a first embodiment of the invention;

FIG. 2 is a side view of the can of FIG. 1;

FIGS. 3 and 4 are side views of the can body and lid of FIGS. 1 and 2 during manufacture;

FIGS. 5, 6, 7 and 8 are views analogous to those of FIGS. 1 to 4, according to a second embodiment of the invention;

FIG. 9 is a side sectional view of a third embodiment of the invention—a food can—which has an angled sealing surface;

FIGS. 10 and 11 are side views of the can of FIG. 9, showing an apparatus for forming the lidding material before and after forming;

FIG. 12 is a schematic side section of another apparatus for forming the lidding material into a cup;

FIG. 13 is a schematic side section of the apparatus of FIG. 12, after forming the cup of lidding material;

FIGS. 14 and 15 are views analogous to FIGS. 1 and 2, showing a fourth embodiment of the invention; and FIG. 16 is a side view of a further embodiment of can which has a barometric lid.

DETAILED DESCRIPTION

FIG. 1 shows a can for packaging foodstuffs, designated by the general reference 10. The food can 10 comprises a metal can body 12 having an access opening 14, a lid 16 (also referred to as foil or lidding material) for closing the access opening 14 and an opening tab 18. The tab 18 shown in FIG. 1 is integral (a single piece) with the lid 16 and projects over the edge of the latter and is folded back onto this lid. Optionally, of course, the tab 18 could be made from a separate piece of material and fixed to the lid 16 in any desired position.

The metal can body 12 is generally cylindrical, having a circular cross-section. The can body 12 thus comprises two extremities. A first extremity forms a peripheral curl 20 which is shaped like a tubular ring ("toric" shape) and borders the access opening 14. The other extremity has a flare 22, on a level with the second extremity, designed to receive a conventional can end (not shown).

The lid 16 is sealed directly onto the can body 12, to an upper part 24A of an inner surface of the can body, adjacent the curl 20. This inner surface 24A delimits the access opening 14 and, in this embodiment, is substantially perpendicular to the plane of the access opening 14. The lid 16 is sealed onto the can body 12 by a tight circumferential seam 26 obtained by fusion (heat sealing) of its material.

The tab 18 of this example is sealed at its base 18A onto the lid 16 in such a way as to keep it folded back onto the lid. The base 18A of the tab 18 corresponds to the part of the tab extending from the junction with the lid 16 along the sealed part of the lid.

The tab 18 is sealed to the lid 16 by fusion of material. More precisely, in the example shown in FIGS. 1 and 2, the outer face of the lid 16 in relation to the can body 12, as well as the face of the tab 18 opposite the lid in folded-back position, are covered by a film which is heat-sealable onto itself, for example of the polyethylene terephthalate (PET) type. The lid 16 and the tab 18 can comprise a non-preformable material; for example, mainly based on polypropylene (pp). This material may in particular have the following composition: 9 microns aluminum, 12 microns nylon (OPA) and 50 to 80 microns polypropylene. As a variant, the lid 16 and tab 18 comprise a pre-formable material; for example, based on aluminum.

A process for manufacturing the can 10 of FIGS. 1 and 2 will now be described. With reference to FIG. 3, after having folded back the tab 18 onto the lid 16, the lid is positioned so that the tab is under the lid and the lid rests on a support 28. The support comprises a fixed disc 30 surrounded by a cylinder 32 which is slidable coaxially relative to the disc 30 and returnable elastically upwards to a position in which its upper annular face 33 is coplanar with that of the disc 30.

The can body 12 is then brought close to the lid 16 so as to apply the peripheral curl 20 against a part of this lid 16. The relative centering of the can body 12 with the lid 16 is ensured by a sleeve 34 for centering the can body relative to the lid's support 28. The periphery of the lid 16 is thus pinched between the curl 20 and the upper annular face 33 of the sliding cylinder 32.

The descent of the can body 12 then brings about the downward sliding of the cylinder 32. The disc 30 then draws the lid 16 along the inner surface 24, the lid being moved in sliding support between the curl 20 and the face 33 of the sliding cylinder 32. At the end of the drawing process, the lid is released from this sliding support and takes the form of a dish with a flat bottom 16A and substantially cylindrical sidewall 16B.

One thus obtains the drawn configuration represented in FIG. 4. While keeping this configuration, the parts of the lid 16 in contact with the upper part 24A of the inner surface 24 are then heated, typically by induction heating either externally to the can upper sidewall or within the dish of the foil lid, so as to seal this lid onto the can body 12 by fusion of its material. The residual heat being diffused in the lid 16 at the same time may be used to seal the tab 18 onto the lid 16 so that two bonds are realized in a single operation. However, it is not always necessary or even desirable to seal the tab onto the can body.

In the following figures, the elements analogous to those of the first embodiment are designated by identical references.

FIGS. 5 and 6 represent a second embodiment of the invention. This embodiment differs from the previous one in that the tab 18 extends over the outside of the can body 12. The manufacturing process of this embodiment is represented in FIGS. 7 and 8. Unlike the process of FIGS. 3 and 4, the lid 16 is centered on the support 28 with the tab folded back. During the stage of drawing the lid 16, the centering sleeve 34 allows the tab 18 to be guided in such a way that it extends along the can body 12.

FIG. 9 shows a third embodiment of the invention, in which the sealing surface 24A is inclined at an angle of 45°. The tab 18 in its folded and unfolded positions corresponds to that shown in FIGS. 1 and 5 respectively. The tab 18 could be pre-folded and then the lidding material placed on the punch 30 (see FIGS. 10 and 11). Alternatively, the punch 30 could be allowed to fold the tab, although care is then required to avoid the tab 18 bonding to the top of the curl of the can body.

In a small scale trial, the embodiments of FIG. 2 (vertical seal) and FIG. 9 were tested by a random group for openability. The vertical sealing surface 24A of the cans of FIG. 2 was considered by many of the group to be unconventional and so individuals had to decide on a new opening technique. Two separate sample batches of cans according to FIG. 2 were tested by the group. In the first batch, 61% of the tabs stayed attached and 31% of the ends were removed completely. In the second batch, only 17% of tabs stayed attached and 8% of the ends were removed completely. The main problem with the FIG. 2 cans appeared to be that the tab was too tight so that it was hard to pull out and to break the seal with the can body. Careful pulling of the tab at the beginning and end of the opening process was required in order to peel open the whole of lid without risk of tearing.

The embodiment of FIG. 9 was also tested for a variety of taper angles, the taper being present on both the sealing surface 24A of the can (FIG. 9) and punch 30A (FIGS. 10 and 11). Cans and punches having tapers of 30°, 40° and 60° were tested. The tab 16 could be pulled and the lidding removed in 100% of the can batches and for all angles tested. Openability was clearly improved with the sealing surface angled outwards as in FIG. 9. It is believed that reducing the angle between the sealing surface 24A and the vertical (direction of tab pull) led to successful opening, even when pulling the tab 18 vertically.

The foil 16 for all embodiments was fixed to the can body 12 by heat sealing. When heating the can using an external induction heater to seal the foil 16 in place, a long delay is necessary to cool the can before the punch 30 can be successfully removed, without dragging the foil out with the punch and degrading the quality of the seal. This can also be improved by using an internal heater radially inboard of the foil 16 and can sidewall 24 so that the can sidewall is not directly adjacent the heater. The foil 16 which is adjacent the heater reduces direct heating of the can body curl 20 which, in turn, may lead to lacquer damage and subsequent rusting of the can body. Furthermore, the tapered can and punch 30 allows the punch to be withdrawn sooner as the foil 16 is not gripped by the punch when tapered.

The rigidity of cans having a taper in the top of the can and top double seam curl and increased can gauge (FIG. 9) was also compared with the straight walled cans (FIG. 2). The straight walled cans 10 of FIG. 2 did not have enough hoop strength to withstand impact before collapsing at a very low height. Gripping of the straight walled cans 10 to open or peel back the foil 16 and transporting on conveyor belts could cause the can to flex inwardly and for product to be forced outwards and spill. The tapered cans of FIG. 9 enabled the cans to be dropped at 0.8 m for a 30° taper, 1.08 m for a 45° taper and 1.23 m for a 60° taper before the foil bursts. When opened by a consumer, tapered wall cans no longer flex inwards.

Cans with a top taper can be stacked without the need for inward necking of the can bottom. The elimination of the neck creates improved axial strength, as well as providing more flat surface area for paper labelling. Straight walled cans 10 of FIG. 2 which had to be necked for stacking caused problems when forming the top curl 20, as the necked-in part requires extra support. Also when induction heating the straight walled can 10, when the clamp pressure is too high the can may crumple if it is slightly out of height specification. This would lead to unacceptable downtime in production lines. The increased top diameter due to the taper in the cans of FIG. 9 allows the bottom of one can to fit snugly into the top of the next can. A 30° taper is a little tight in stacking, 60° is a little loose and around 45° is about ideal.

When the foil 16 is sealed to the can body, the lower the sealing surface 24A angle, the greater the tendency for the foil to wrinkle when sealed and processed with a vacuum (low pressure). A taper of 30° or more reduces this wrinkling to the point of acceptability.

The apparatus of FIG. 12 shows a base support 110 of polymeric, glass or ceramic material which includes a mandrel portion 112 which enters a can body 120. The can body 120 has been formed in conventional manner for a so-called three piece can, by welding a sheet of lacquered tinplate into a cylinder. A further lacquer layer ("side stripe") is painted, roller coated or sprayed over the welded side seam. Can body 120 is shown in diagrammatic form only and not in any way to scale. The can body 120 is flanged at one end, this end being known as "the filler's end", being the end through which the can body is filled with product. The flange 122 contacts plate 114 of the base support 110. This end may also be necked to reduce the sidewall diameter by typically 1 to 4 mm for improved stackability of the filled and closed container.

At the opposite end, the can body 120 has a curl 126. The lidding material 160 will be fixed to this end prior to filling, as is described in more detail below. A punch 130 surrounded by ejector 140 and foil locator 150 supports lidding material 160 in the start position shown in FIG. 12. The base support 110 is pushed into the open end of the can body 120 with the piston and ejector biased against the curl 126.

The lidding material 160 of the example shown in the figures may be a foil type of lidding or a flexible lidding. One example of a foil lidding material comprises a base layer of peelable polypropylene of about 25 microns thickness, a layer of aluminum of from 40 to 90 microns thickness (typically around 70 microns), and a print, lacquer, PET layer or other coating. Optionally, a thin layer of corrosion resistant lacquer may be provided between the polypropylene layer and the aluminum layer. The polypropylene layer is generally a single layer having about 7 microns of polypropylene which has been modified so as to adhere to the aluminum layer, and about 18 microns of polypropylene modified with polyethylene and/or other materials which is peelable when sealed against polypropylene.

One example of a flexible lidding material comprises a base layer of 25 to 100 microns or more of polypropylene, which has been modified to be peelable, 6 to 40 microns of aluminum, and 12 to 25 microns of polyethylene terephthalate (PET).

Another example is to use the same lidding material, but with 15 to 30 microns of a nylon between the polypropylene and the aluminum.

In the position shown in FIG. 13, the punch 130 has entered the curled end of the can body 120, carrying the lidding material 160 with it. The lidding material 160 is drawn around the curl 126 until the sidewall of the lidding material cup 160' contacts the can body sidewall by at least 2 mm (typically between 2 and 5 mm).

In FIG. 13, the lidding material cup 160' extends into an integral tab 162 for ease of opening the can. This tab 162 could be folded over before, during or after forming, or alternatively could be a discrete tab which is positioned elsewhere on the lidding material, for example in the center of the cup. In this case, the tab could be fixed to the cup after forming, or to the lidding material prior to the drawing operation.

After the lidding material cup 160' has been formed, the apparatus is passed through an induction coil with at least the base support 110, can body 120 and punch 130 remaining in position. Heat is induced in the can body 120 and lidding material 160 so that the polypropylene layer of the lidding material bonds to polypropylene in the lacquer to fix the lidding cup to the can body. Because the punch 130 and base support 110 are of polymeric, glass or ceramic material, no heat is induced in these components and the polypropylene will not adhere to them.

When the lidding material cup 160' has been bonded to the can sidewall, the punch 130 is withdrawn whilst the ejector 140 is held against the curl 126. A taper provided on the can and punch improves this removal; a taper of up to 90° or as in the specific examples of FIG. 9 will improve release of the can. The can body 120 which is closed by the cup 160' is then removed from the base support mandrel 112 for filling. In contrast with can bodies of the prior art, the can body 120 of the present invention is closed by the peelable membrane by the can manufacturer, and the filler can fill and close the base of the can with conventional machinery without the requirement to be able to fix a peelable membrane closure. This is clearly of great benefit to the filler.

The punch could be profiled and/or biased radially to ensure good contact over the bond region, particularly over the welded side seam. Alternative methods of biasing such as use of a conformed tool, springs, pneumatic or separate punch segments are possible.

Although the embodiment of FIGS. 12 and 13 has been described with the can body being used as the forming die and avoiding the need for an intermediate ring to which the membrane is fixed, it would clearly be possible (although not as economic) to use an intermediate ring as the forming die.

The fourth embodiment of FIGS. 14 and 15 differs from the previous ones in that the lid is sealed directly onto an outer surface of the can body 12. More precisely, it is sealed onto the toric curl 20 and, in particular, onto the outermost surface 36 of the latter, which is more or less perpendicular to the plane of the access opening 14.

The final embodiment of FIG. 16 shows a container for a barometric lid, in which the sealing surface 24A angle is 115° to the vertical. Although this extends the sealing surface significantly beyond the can body diameter, this enables in-can pressure during processing of a food product in the container to be controlled. The bond of the sealing surface 24A of FIG. 16 only undergoes shear loading and thereby improves burst pressure performance significantly. The container of FIG. 16 can thus be used for processing of products in non-overpressure processes, such as using hydrostatic or reel and spiral retorts.

Thus in each embodiment, the lid is tightly sealed directly onto a surface of the can body. Where the sealing surface is parallel to the central axis of the can 10, the seal is broken by shearing which ensures a firm hold of the lid 16 on the can body. Where the sealing surface is inclined, opening forces are substantially reduced and opening is achieved without risk of tearing of the tab.

What is claimed:

1. A method for manufacturing a can for food packaging, the method comprising:

supporting a lidding material on a punch, the lidding material defining a tab, the tab configured to be grasped by the user to remove the lidding material from a metal can body;

positioning the metal can body having an open end, an outwardly extending curl disposed about the open end, a sidewall, and a sealing surface adjacent the curl, the sealing surface being inclined upwards and outwards with respect to a can body center axis at an angle between 20° and 60°;

supporting the can body on a base support;

moving the can body and punch relative to each other;

drawing the lidding material that is carried by the punch, along the sealing surface of the can body; and sealing the lidding material directly to the sealing surface of the can body.

2. A method according to claim 1, wherein the sealing step comprises induction heating at least one of the lidding material and the can body so as to bond the lidding material directly to the can body.

3. A method according to claim 1, wherein the step of moving the can body and punch relative to each other comprises pushing the can body with the base support while the punch is moved into the can body, or holding the punch stationary while the can body is moved axially over the punch, or a combination of these.

4. An apparatus for forming a sealed food can, the apparatus comprising:

a metal can body having an open end, an outwardly extending curl, a sidewall, and a sealing surface adjacent the curl, the sealing surface being inclined upwards and outwards with respect to a can body center axis at an angle between 20° and 60°;

a base support for supporting the can body; and a punch configured to carry a lidding material that defines a tab, the tab configured to be grasped by the user to remove the lidding material from the metal can body;

wherein the can body acts as a forming die such that, in use, the lidding material is adapted to be drawn along the sealing surface of the can body and is held directly against the sealing surface for bonding.

5. An apparatus according to claim 4, in which the punch has an end portion which has a diameter which is less than that of the can body inner wall and which extends axially at least 2 mm.

6. An apparatus according to claim 4, further including an induction heater coil that surrounds the can body either externally or radially-inboard of the can body and lidding material.

7. An apparatus according to claim 4, wherein the can body is formed from a metal sheet into a cylinder and a side seam formed from the metal sheet is coated with an internal lacquer or with a polypropylene powder.

8. An apparatus according to claim 4, wherein the base support comprises a plate that is coated with a conventional lacquer and a lacquer which includes a dispersion lacquer is used only for coating that part of the can and side seam which is to contact the lidding material.

* * * * *